United States Patent [19]

Seguin

[11] Patent Number: 4,669,652

[45] Date of Patent: Jun. 2, 1987

[54] TWO-WAY MAILING ENVELOPE

[76] Inventor: Sylvain Seguin, 9330, 25th Avenue, Montreal, Quebec, Canada, H1Z 4E4

[21] Appl. No.: 892,388

[22] Filed: Jul. 31, 1986

[51] Int. Cl.[4] ..... B65D 27/06

[52] U.S. Cl. ..... 229/73; 229/69

[58] Field of Search ..... 229/73, 71, 69, 92, 229/92.8

[56] References Cited

U.S. PATENT DOCUMENTS

| | | | |
|---|---|---|---|
| 3,411,699 | 11/1968 | Pine et al. | 229/73 |
| 3,428,237 | 2/1969 | Dowen | 229/73 |
| 3,437,259 | 4/1969 | Steidinger | 229/73 |
| 4,055,294 | 10/1977 | Traise | 229/69 |
| 4,332,346 | 6/1982 | Kronman | 229/73 |
| 4,445,635 | 5/1984 | Barr | 229/73 |

FOREIGN PATENT DOCUMENTS

| | | | |
|---|---|---|---|
| 2383083 | 11/1978 | France | 229/73 |

*Primary Examiner*—Willis Little

*Attorney, Agent, or Firm*—Ralph W. Selitto, Jr.

[57] ABSTRACT

A two-way mailing envelope for both first and return mailing is disclosed, which has top, bottom and side edges and comprises a pair of panels foldably connected to each other along one fold line extending along the bottom edge and folded over one another to form a first mailing envelope, first adhesive means adhesively fastening in superimposed relationship side edge portions of the panels, and first and second side tear strips severable along respective first and second tear lines and including the side edge portions. A first adhesive closure flap is foldably connected to the one panel along another fold line extending along the top edge, the first adhesive closure flap being foldable along the other fold line to seal the first mailing envelope. Third and fourth tear lines are equidistantly spaced inwardly and outwardly from the other fold line to define a third tear strip when the first adhesive closure flap is folded to seal the first mailing envelope such that the sealed first mailing envelope is adapted to be converted into a return envelope by tearing off the first, second and third tear strips and by refolding the panels inside out along the one fold line to form the return envelope. Second adhesive means are provided inwardly of and adjacent the edge portions of one of the panels for adhesively fastening together the panels when refolded inside out. A second adhesive closure flap is foldably connected to the other panel along a further fold line extending parallel to the one fold line, the second adhesive closure flap being folded along the further fold line to nest inside the first mailing envelope and being unfoldable to seal the return envelope when formed.

18 Claims, 11 Drawing Figures

TWO-WAY MAILING ENVELOPE

BACKGROUND OF THE INVENTION

The present invention relates to improvements in mailing envelopes. More particularly, the invention is concerned with an improved two-way mailing envelope which, when received, can be converted into a return envelope for returning an enclosure, payment or the like.

Two-way mailing envelopes are used extensively in mail order businesses as well as in the distribution and collection of accounts. Hitherto known two-way mailing envelopes formed from single blanks comprise at least three panels folded and glued with appropriate perforated lines to provide both the first and return mailing envelopes. Examples of such envelopes are described in U.S. Pat. Nos. 3,652,007, 3,977,597 and 4,487,360.

For instance, the two-way envelope of U.S. Pat. No. 4,487,360 comprises front, rear and return panels that are joined together and folded to provide a semi-permanent fully enclosed pocket for the first mailing and a separate permanent fully enclosed pocket for the return mailing. The permanent pocket for the return mailing is formed by adhering the rear panel to the return panel. The semi-permanent pocket for the first mailing is formed by providing the front panel and one of the rear and return panels with detachable side extensions that are adhered together. Upon receipt of the envelope by the first addressee, the side extensions are removed and the front and rear panels are separated along an appropriate perforated line, thereby leaving intact the return envelope portion with its permanent pocket for return mailing. Although such a two-way mailing envelope does not require a complex manipulation for converting from its first mailing mode to its return mode, it still requires substantially the same amount of paper needed to form two separate envelopes and therefore does not allow for an economy of paper.

SUMMARY OF THE INVENTION

Accordingly, it is an object of the present invention to provide an improved two-way mailing envelope and blank therefor, in which only two panels are used to form both the first and return mailing envelopes, thereby enabling a substantial economy of paper.

In accordance with one aspect of the invention, there is provided a two-way mailing envelope for both first and return mailing, having top, bottom and side edges and comprising a pair of panels foldably connected to each other along one fold line extending along the bottom edge and folded over one another along the one fold line to form a first mailing envelope with one fold line to form a first mailing envelope with one of the panels defining a front panel of the first mailing envelope and the other panel defining a rear panel thereof; first adhesive means adhesively fastening in superimposed relationship side edge portions of the panels to form a pocket for the first mailing envelope; and first and second side tear strips severable along respective first and second tear lines and including the side edge portions. A first adhesive closure flap is foldably connected to the one panel along another fold line extending parallel to the one fold line and along the top edge of the first mailing envelope, the first adhesive closure flap being foldable along the other fold line to seal the first mailing envelope. Third and fourth tear lines are equidistantly spaced inwardly and outwardly from the other fold line to define a third tear strip when the first adhesive closure flap is folded to seal the first mailing envelope such that the sealed first mailing envelope is adapted to be converted into a return envelope by tearing off the first, second and third tear strips and by refolding the panels inside out along the one fold line to form the return envelope with the one panel and the other panel defining respectively rear and front panels of the return envelope. Second adhesive means are provided inwardly of and adjacent the edge portions of one of the panels for adhesively fastening together the panels when refolded inside out to form a pocket for the return envelope. A second adhesive closure flap is foldably connected to the other panel along a further fold line extending parallel to the one fold line, the second adhesive closure flap being folded along the further fold line to nest inside the first mailing envelope and being unfoldable to seal the return envelope when formed.

Thus, according to the invention, by using the same two panels which are used to form the first mailing envelope for forming the return envelope, not only is the envelope of the invention easily convertible from its first mailing mode to its return mode but it also allows for a substantial economy of paper.

Preferably, the side edge portions of the panels are adhesively fastened by means of a pair of side sealing flaps provided with the first adhesive means and foldably connected to one of the panels along respective fold lines extending along the side edges, the side sealing flaps being folded along the respective fold lines to adhesively fasten the side edge portions. Such an arrangement enables to provide a first mailing envelope having a pocked with maximum dimensions.

According to a preferred embodiment, the envelope further includes fifth and sixth tear lines equidistantly spaced respectively inwardly and outwardly from the further fold line and defining a fourth tear strip substantially coextensive with the third tear strip and enclosable therewithin when the first adhesive closure flap is folded to seal the first mailing envelope such that the third and fourth tear lines register with the fifth and sixth tear lines whereby the third and fourth tear strips are detachable together. First and second spaced-apart score lines are defined in the second adhesive closure flap between a terminal edge thereof and the sixth tear line with the first score line located adjacent the sixth tear line, the sixth tear line together with first and second score lines subdividing the second adhesive closure flap into first, second, third and fourth flap portions with the first flap portion being delimited by the further fold line and the sixth tear line, the second flap portion delimited by the sixth tear line and the first score line, the third flap portion delimited by the first and second score lines and the fourth flap portion delimited by the second score line and the terminal edge and having a strip of adhesive extending adjacent the terminal edge for sealing the return envelope. The second flap portion also has adhesive for adhesion to the other panel such as to permit the third and fourth flap portions to remain foldably connected to the other panel when the first, second, third and fourth tear strips are torn off, the third flap portion being foldable over the second flap portion along the first score line and the fourth flap portion being foldable along the second score line to seal the return envelope. Preferably, the first flap portion as well as edge portions of the third and fourth flap portions are provided with adhesive for adhesion to the other panel such that the second adhesive closure flap when nested inside the first mailing envelope lies in a plane parallel to the plane of the other panel.

In a particularly preferred embodiment of the invention, the first and second tear lines extend in parallel relationship and each have four rectilinear sections extending respectively across the two panels and the first and second adhesive closure flaps in registry with one another when the first adhesive closure flap is folded to seal the first mailing envelope. The second adhesive means comprise two strips of pressure-sensitive adhesive arranged on one of the panels inwardly of and adjacent the edge portions thereof, the strips of pressure-sensitive adhesive extending parallel to the first and second tear lines and each being covered by a peel-off protective tape. The protective tape is peelable to expose the pressure-sensitive adhesive of each strip for adhesively fastening together the panels when refolded inside out to form the return envelope. Preferably, the strips of pressure-sensitive adhesive are arranged on the one panel and each terminates at one end a short distance from the third tear line, whereas each protective tape extends beyond the one end of each adhesive strip and across the third tear line to terminate at one end between the other fold line and the third tear line. Each protective tape has both ends thereof permanently secured to the one panel and are severable at the one end along the third tear line and at the other end along a transverse tear line formed in the tape adjacent the other end. Such an arrangement enables accidental peeling-off of the protective tapes at the ends thereof to be prevented while allows each protective tape to be severed at the one end thereof along the third tear line upon tearing off the third tear strip.

According to an alternative embodiment, a pair of score lines are defined in the one panel inwardly of and adjacent the edge portions thereof, each score line extending across the one panel. The first and second tear lines each have a first line section extending across the first adhesive closure flap in alignment with a respective one of the score lines, a second line section which is offset relative to the first line section and extends across the one panel intermediate the respective score line and a respective one of the side edges, a third line section extending across the other panel and the second adhesive closure flap in registry with the respective score line, and a fourth line section interconnecting the second and third line sections and extending along the one fold line. The second adhesive means comprise a pair of adhesive strips arranged on the one panel and each extending between a respective one of the score lines and a respective one of the second line sections to thereby define a pair of foldable side sealing flaps for adhesively fastening together the panels when refolded inside out form the return envelope, the adhesive of the side sealing flaps being exposable upon tearing off the first and second tear strips and the side sealing flaps being foldable along the score lines to adhesively fasten the panels.

The panel which defines the front panel of the first mailing envelope is advantageously formed with a window through which may be displayed address information for first mailing. An information sheet may also be detachably connected to the second adhesive closure flap along a further tear line extending along the terminal edge of said second adhesive closure flap, the information sheet having information printed thereon including the above address information. Such an information may be divided for example into two detachable portions along yet another tear extending parallel to the further tear line, one portion defining a statement of charges and the other portion defining a return stub to accompany payment The present invention also provides, in another aspect thereof, a blank for forming a two-way mailing envelope as defined above, comprising an elongated sheet having a pair of longitudinally extending side edges and a pair of transversely extending end edges, and first and second tear lines inwardly spaced from the side edges and running the entire length of the sheet to define a pair of severable, longitudinally extending edge portions. First, second and third transversely extending, parallel fold lines divide the sheet into first, second, third and fourth panels foldably connected to one another along the fold lines with the first panel being delimited by one of the end edges and the first fold line, the second panel delimited by the first and second fold lines, the third panel delimited by the second and third fold lines and the fourth panel delimited by the third fold line and the other end edge. The second and third panels are foldable over one another along the second fold line to form a first mailing envelope with the second and third panels defining respectively front and rear panels of the first mailing envelope. First adhesive means are provided for adhesively fastening in superimposed relationship the edge portions of the second and third panels when folded over one another to thereby define opposite first and second tear strips. The first panel defines a first adhesive closure flap foldable along the first fold line to seal the first mailing envelope. Transversely extending third and fourth tear lines are equidistantly spaced respectively inwardly and outwardly from the first fold line to define a third tear strip when the first adhesive closure flap is folded to seal the first mailing envelope such that the sealed first mailing envelope is adapted to be converted into a return envelope by tearing off the first, second and third tear strips and by refolding the second and third panels inside out along the second fold line to form the return envelope with the second and third panels defining respectively rear and front panels of the return envelope. Second adhesive means are provided inwardly of and adjacent the edge portions of one of the second and third panels for adhesively fastening together the second and third panels when refolded inside out. The fourth panel defines a second adhesive closure flap foldable over the third panel along the third fold line to nest inside the first mailing envelope and being unfoldable to seal the return envelope when formed.

The blank according to the invention can be produced from a continuous web of paper by high speed automatic machines and printed with the desired address information for both first and return mailing by laser printers.

BRIEF DESCRIPTION OF THE DRAWINGS

Further features and advantages of the invention will become more readily apparent from the following description of preferred embodiments as illustrated by way of example in the accompanying drawings, in which.

DESCRIPTION OF PREFERRED EMBODIMENTS

Figure 1:
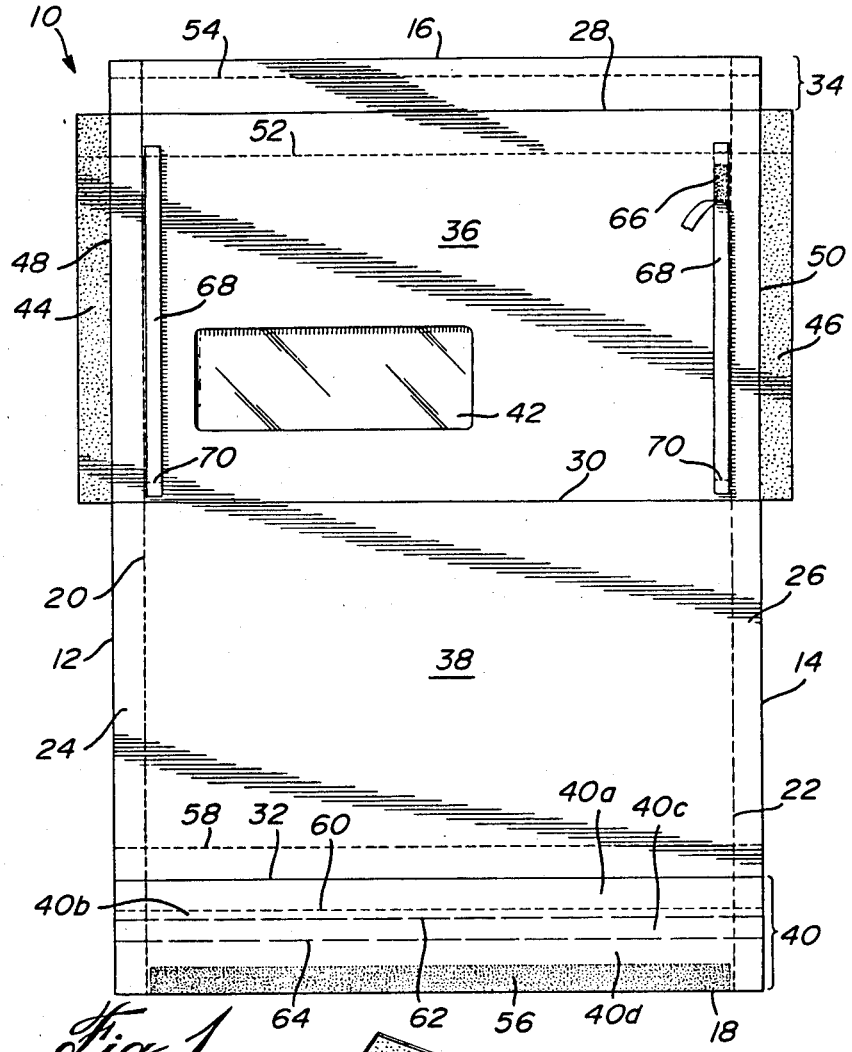
FIG. 1 is a top plan view of a blank for forming a two-way mailing envelope according to a preferred embodiment of the invention.

Referring first to FIG. 1, there is illustrated a blank 10 from which a two-way mailing envelope may be formed. The blank 10 has inner and outer surfaces (outer surface shown in FIG. 1) as well as a pair of longitudinally extending side edges 12,14 and a pair of transversely extending end edges 16,18. Two rectilinear tear lines 20 and 22 inwardly spaced from the side edges 12,14 extend in parallel relationship for the full length of the blank to define a pair of severable, longitudinally extending edge portions 24 and 26. Three transversely extending, parallel fold lines 28, 30 and 32 divide the blank into four panels 34, 36, 38 and 40 foldably connected to one another along the fold lines 28, 30 and 32. The panels 36 and 38 being foldable over one another along fold line 30 to form a first mailing envelope with panels 36 and 38 defining respectively the front and rear panels of the first mailing envelope. A viewing window 42 is formed in the panel 36, through which may be displayed address information for first mailing. Two longitudinally extending panels 44 and 46 provided with adhesive are foldably connected to the edge portions 24 and 26 of panel 36 along fold lines 48 and 50 extending along the side edges 12 and 14 to define a pair of foldable side sealing flaps for adhesively fastening in superimposed relationship the edge portions of panels 36 and 38 when these are folded over one another. It is apparent, however, that the side sealing flaps 44 and 46 instead of being foldably connected to the edge portions of panel 36 could also be foldably connected to the edge portions of panel 38 for the same purpose. Moreover, such side sealing flaps could be completely dispensed with and adhesive could be provided directly on the edge portions of one of the panels 36 and 38 for adhering same.

Figure 2:
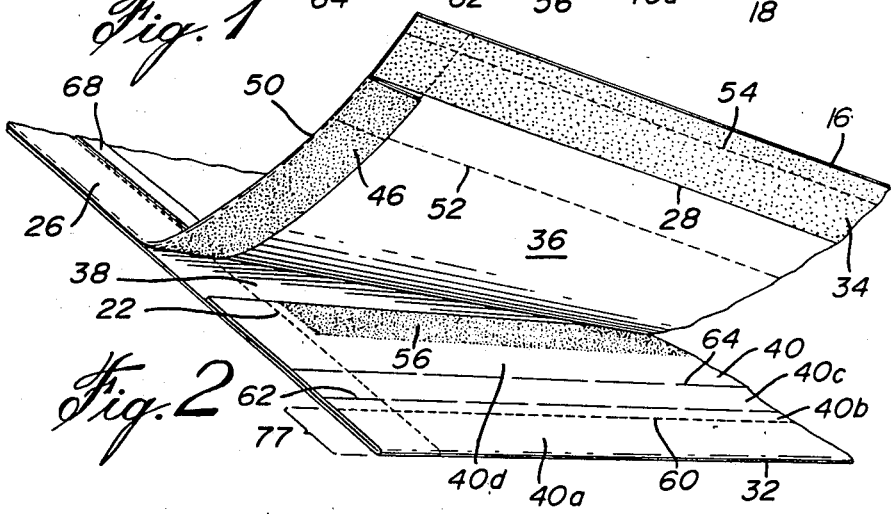
FIG. 2 is a fragmentary perspective view illustrating how a first mailing envelope is formed from the blank shown in FIG. 1.

The panel 34 which is provided with adhesive on its inner surface, as best shown in FIG. 2, is adapted to define a first adhesive closure flap foldable along the fold line 28 to seal the first mailing envelope. Two transversely extending tear lines 52 and 54 are equidistantly spaced respectively inwardly and outwardly from the fold line 28. The panel 40, on the other hand, is adapted to define a second adhesive closure flap for sealing the return envelope into which the first mailing envelope is ultimately converted, and to this end is provided with a strip of adhesive 56 extending adjacent the end edge 18. The panel 40 is foldable along the fold line 32 to nest inside the first mailing envelope. Two transversely extending tear lines 58 and 60 are equidistantly spaced respectively inwardly and outwardly from the fold line 32, and two transversely extending spaced-apart score lines 62 and 64 are defined in the panel 40 between the tear line 60 and the end edge 18 with the score line 62 located adjacent the tear line 60. The tear line 60 together with the score lines 62 and 64 subdivide the panel 40 into four sub-panels 40*a*, 40*b*, 40*c* and 40*d*, the sub-panel 40*d* carrying the strip of adhesive 56. The sub-panels 40*a* and 40*b* as well as the edge portions of sub-panels 40*c* and 40*d* also have adhesive on their inner faces, similarly as that shown in FIG. 7B, for adhesion to panel 38 when the panel 40 is folded to nest inside the first mailing envelope.

The adhesive which is provided on the panels 34 and 40 as well as on the panels 44 and 46 is preferably of the dry adhesive type, such that the adhesive does not cause adhering until it is moistened.

Two longitudinally extending strips of pressure-sensitive adhesive 66 are arranged on the panel 36 inwardly of and adjacent the edge portions thereof and extend parallel to the tear lines 20 and 22, each adhesive strip 66 being covered by a peel-off protective tape 68. The strips of pressure-sensitive adhesive 66 each terminate at their upper end a short distance from the tear line 52. Each protective tape 68, on the other hand, extends beyond the upper end of each adhesive strip 66 and across the tear line 52 to terminate at its upper end between the fold line 28 and the tear line 52. Both the upper and lower ends of each protective tape 68 are permanently secured to the panel 36 to prevent accidental peeling-off. The protective tapes 68 are each severable at their upper end along the tear line 52 and at their lower end along a transverse tear line 70 formed in each tape adjacent their lower end.

In order to form a first mailing envelope from the blank 10 illustrated in FIG. 1, the adhesive provided on sub-panels 40*a* and 40*b* as well as on the edge portions 24,26 of sub-panels 40*c* and 40*d* is first moistened and the panel 40 is folded over the panel 38 along fold line 32 so that the sub-panels 40*a*,40*b* and the edge portions of sub-panels 40*c*,40*d* adhere to the panel 38 with the panel 40 lying in a plane parallel to the plane of panel 38, as shown in FIG. 2. The side sealing flaps 44 and 46 are then folded over along the fold lines 48 and 50, the adhesive thereof is moistened and the panels 36 and 38 are folded over one another along the fold line 30 so that the side sealing flaps adhere to the edge portions 24,26 of the panel 38, thereby adhesively fastening in superimposed relationship the edge portions of the panels 36 and 38 with the flaps 44 and 46 therebetween. In this manner, a first mailing envelope is formed having a pocket of maximum dimensions, the panels 36 and 38 defining respectively the front and rear panels of the envelope thus formed.

Figure 3:
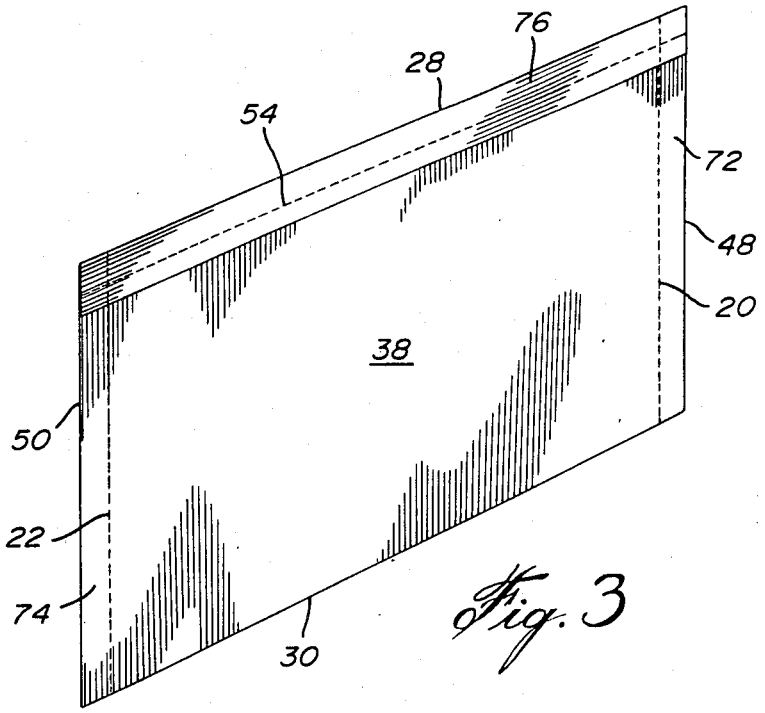
FIG. 3 is a rear perspective view of the first mailing envelope thus formed and shown sealed.

The first mailing envelope is sealed by moistening the adhesive of the closure flap 34 and folding the latter along the fold line 28 to close and seal the envelope. The sealed first mailing envelope is illustrated in FIG. 3.

When the first mailing envelope is sealed, the tear lines 20 and 22 each have four rectilinear sections extending respectively across the panels 34, 36, 38 and 40 in registry with one another and thus define a pair of side tear strips 72 and 74 enclosing the side sealing flaps 44 and 46. The tear lines 52, 54, 58 and 60 also register with one another and define two top tear strips 76 and 77 with the tear strip 77 being substantially coextensive with the tear strip 76 and enclosed therewithin; the tear strip 77 comprises the sub-panel 40*a* and the panel extending the fold line 32 and the tear line 58. Both top tear strips 76 and 77 are detachable together.

Figure 4:
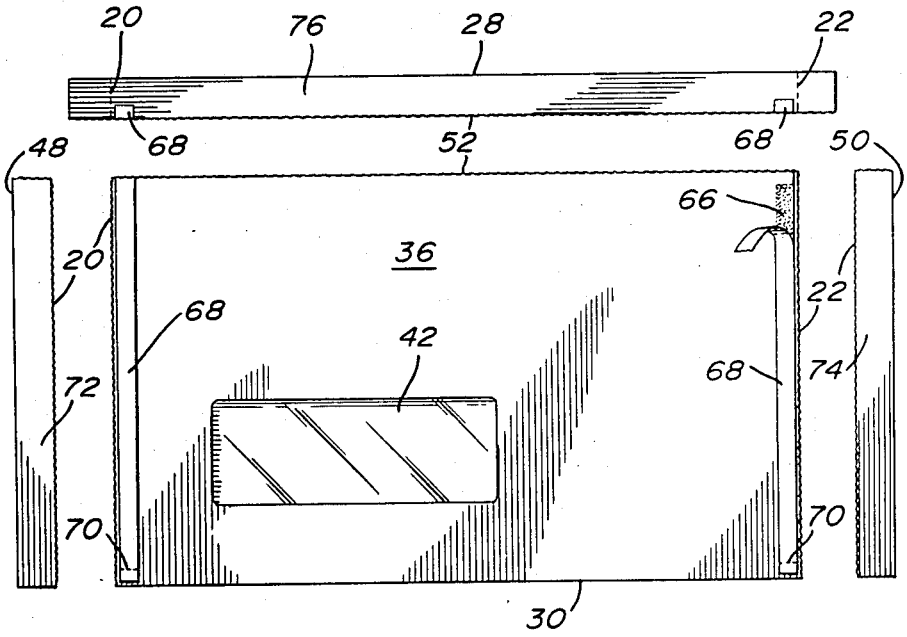
FIGS. 4, 5 and 6 are respectively front elevation, perspective and sectional views illustrating how the first mailing envelope formed from the blank of FIG. 1 can be converted into a return envelope.
Figure 5:
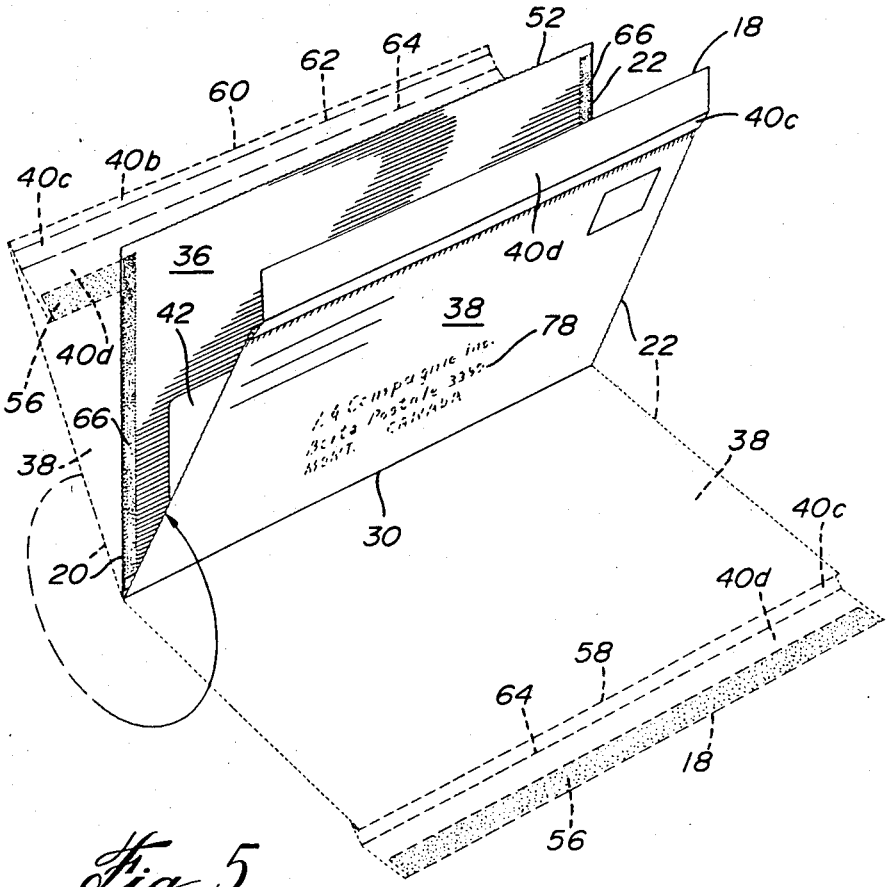

The first mailing envelope formed from the blank 10 is converted into a return envelope by first tearing off the tear strips 72, 74 and 76, as shown in FIG. 4; the tear strip 77 which is enclosed within the tear strip 76 is also torn off upon tearing the tear strip 76. Upon tearing off the top tear strip 76, the protective tapes 68 are severed at their upper ends and, since the adhesive strips 66 terminate a short distance from the tear line 52, the protective tapes 68 can be easily grasped between one's fingers and peeled off to expose the pressure-sensitive adhesive 66. The panels 36 and 38 are then refolded inside out along the fold 30 and adhesively fastened together by means of the pressure-sensitive adhesive 66 to form a pocket for the return envelope, as shown in FIG. 5. The panels 36 and 38 thus define respectively the rear and front panels of the return envelope, and the panel 38 can be preaddressed for return mailing such as shown at 78.

Figure 6:
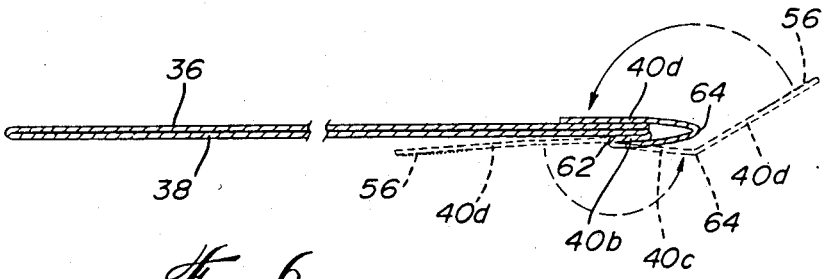

The return envelope thus formed is sealed in the manner shown in FIG. 6. Since the sub-panel 40*b* is adhered to the panel 38, the sub-panels 40*c* and 40*d* of the adhesive closure flap 40 which nested inside the first mailing envelope remain foldably connected to the panel 38 after the tear strip 77 has been torn off. Thus, as shown in FIG. 6, the return envelope is sealed by first folding the sub-panel 40*c* over the sub-panel 40*b* along the score line 62, moistening the adhesive 56 on the sub-panel 40*d* and then folding the latter along the score line 64 to close and seal the envelope.

Figure 7B:
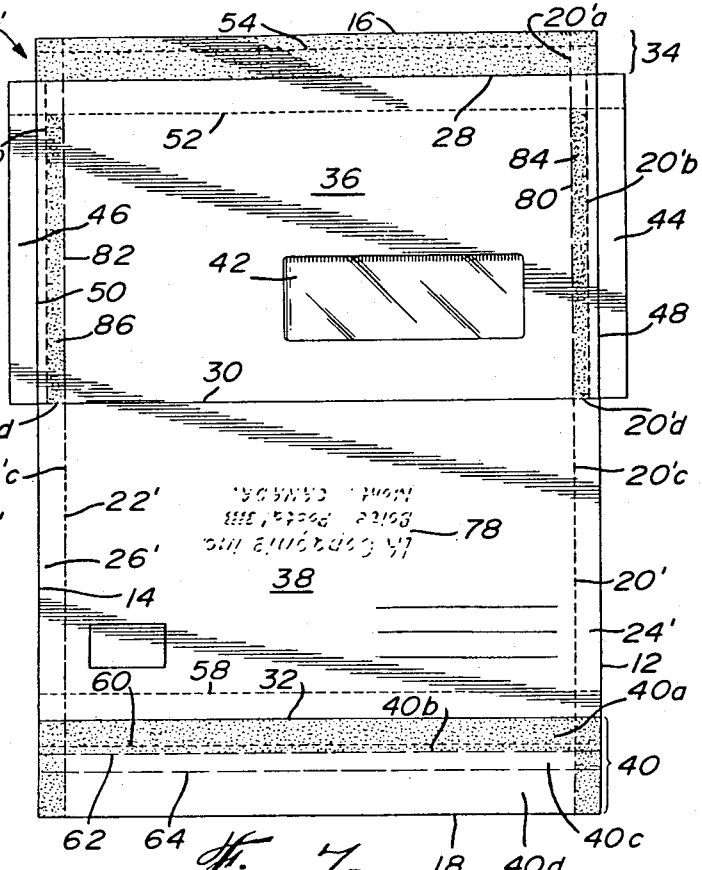
FIGS. 7A and 7B are top and bottom plan views of another blank for forming a two-way mailing envelope according to another preferred embodiment of the invention.
Figure 7A:
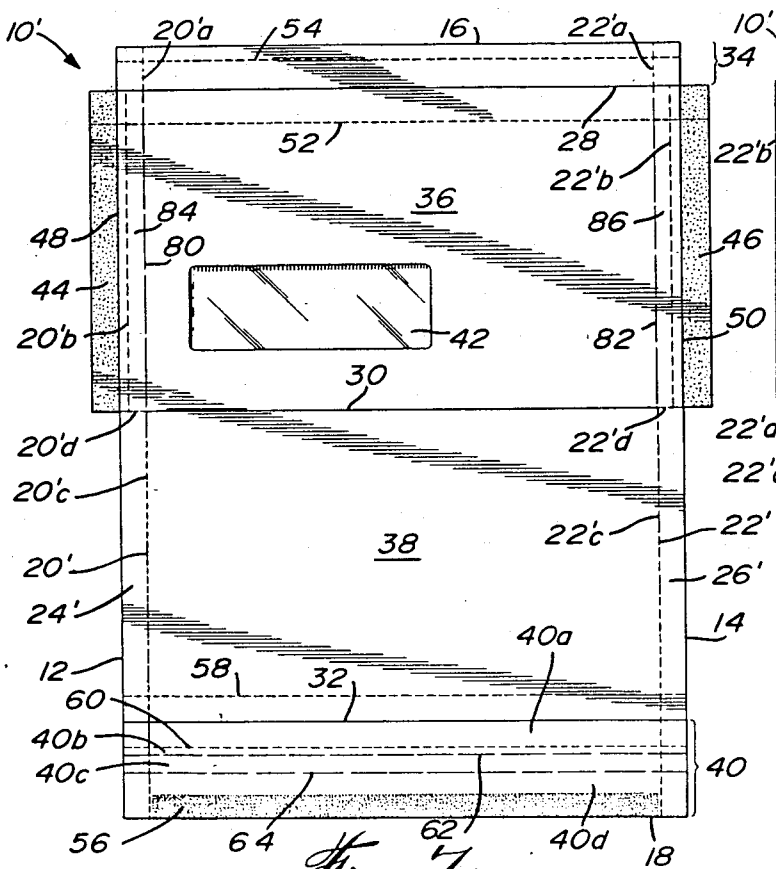

Turning to FIGS. 7A and 7B which illustrate another blank 10' for forming a two-way envelope according to another preferred embodiment, the blank 10' is essentially the same as the blank 10 shown in FIG. 1, except that the tear lines 20' and 22' run differently from the tear lines 20 and 22 along the length of the blank and thus define edge portions 24' and 26' having a different outline, and the two strips of pressure-sensitive adhesive 66 with the peel-off protective tapes 68 shown in FIG. 1 are replaced by a pair of foldable side sealing flaps 84 and 86 for adhesively fastening together the panels 36 and 38 when refolded inside out to form the return envelope.

As shown in FIGS. 7A and 7B, a pair of longitudinally extending score lines 80 and 82 are defined in the panel 36 inwardly of and adjacent the edge portions 20',22' thereof, each score line extending across the panel 36. The tear line 20' has a longitudinally extending first line section 20'*a* extending across the panel 34 in alignment with the score line 80, a longitudinally extending second line section 20'*b* which is off-set relative to the first line section 20'*a* and runs across the panel 36 intermediate the fold line 48 and the score line 80, a longitudinally extending third line section 20'*c* running across the panels 38 and 40 in alignment with the score line 80, and a transversely extending fourth line section 20'*d* interconnecting the second and third line sections 20'*b* and 20'*c* and running along the fold line 30. Similarly, the tear line 22' has a longitudinally extending first line section 22'*a* extending across the panel 34 in alignment with the score line 82, a longitudinally extending second line section 22'*b* which is off-set relative to the first line section 22'*a* and runs across the panel 36 intermediate the fold line 50 and the score line 82, a longitudinally extending third line section 22'*c* running across the panels 38 and 40 in alignment with the score line 82, and a transversely extending fourth line section 22'*d* interconnecting the second and third line sections 22'*b* and 22'*c* and running along the fold line 30.

Adhesive is provided on the panel 36 in the area defined between the tear line section 20'*b* and the score line 80 as well as in the area defined between the tear line section 22'*b* and the score line 82 to thereby define a pair of side sealing flaps 84 and 86 foldable along the score lines 80 and 82 for adhesively fastening together the panels 36 and 38 when these are refolded inside out to form the return envelope.

The first mailing envelope which is formed from the blank 10' is formed in exactly the same way as that formed from the blank 10. It is also sealed in the same way, using the adhesive closure flap 34.

Figure 8:
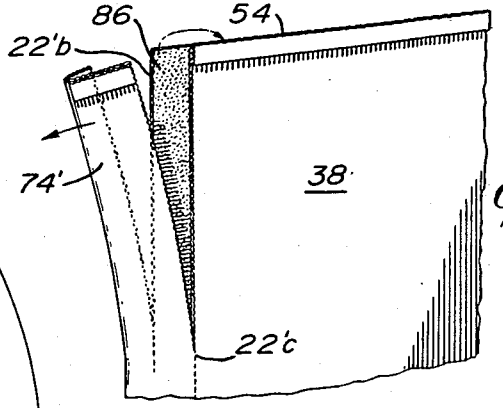
FIGS. 8, 9 and 10 illustrate how the first mailing envelope formed from the blank shown in FIGS. 7A and 7B can be converted into a return envelope.
Figure 10:
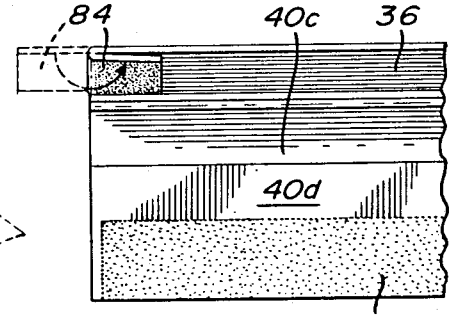
Figure 9:
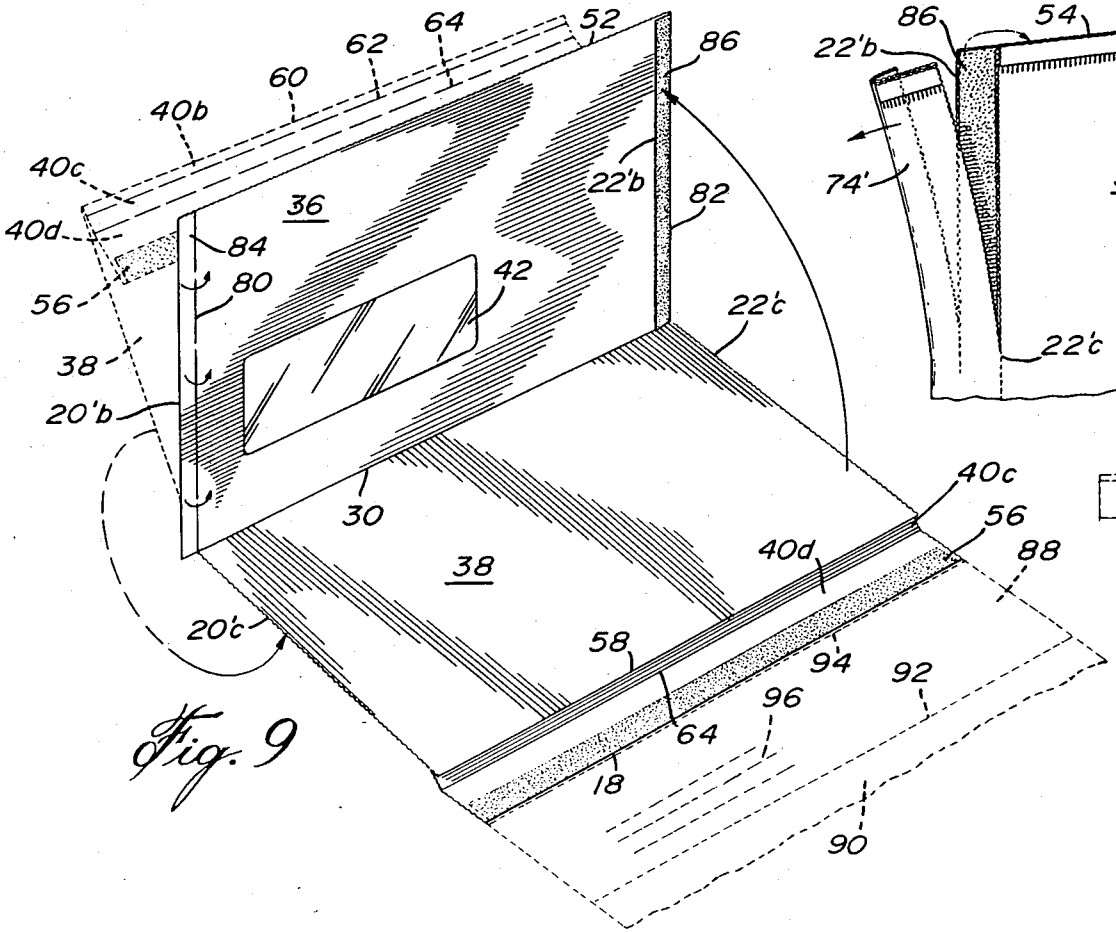

The manner in which the first mailing envelope formed from the blank 10' is converted into a return envelope is illustrated in FIGS. 8–10. The side and top tear strips of the sealed first mailing envelope are first torn off as in the former embodiment. Upon tearing off the side tear strips (one side tear strip 74' being shown in FIG. 8), the adhesive of the side sealing flaps 84 and 86 become exposed for moistening. The side sealing flaps 84 and 86 are then folded over along the score lines 80 and 82, the adhesive thereof is moistened and the panels 36 and 38 are refolded inside out along the fold line 30 so that the side sealing flaps 84 and 86 adhere to the panel 38 and thereby adhesively fasten the panels 36 and 38 together to form a pocket for the return envelope, the panels 36 and 38 defining respectively the rear and front panels of the return envelope thus formed.

Such a return envelope is sealed in the same way as in the former embodiment and shown in FIG. 6.

An information sheet optionallyl divided into two portions 88,90 along tear line 92 may be detachably connected to sub-panel 40*d* of the adhesive closure flap 40 along the tear line 94 extending along the terminal edge 18. The first portion 88 of such an information sheet may constitute for instance a return stub to accompany payment whereas the other portion 90 may constitute a statement of charges detachable along the tear line 92 and retainable by the first addressee. The return stub 88 may have printed thereon at 96 address information for first mailing, which address information is adapted to register with the window 42 when the adhesive closure flap 40 is nested inside the first mailing envelope and also serves to identify the customer when the return stub 88 is forwarded back with payment.

As it is apparent, the two-way mailing envelope formed from the blank 10 or 10' is not only easily convertible from its first mailing mode to its return mode, but also allows for a substantial economy of paper.

I claim:

1. A blank for forming a two-way mailing envelope, comprising an elongated sheet having a pair of longitudinally extending side edges and a pair of transversely extending end edges; first and second tear lines inwardly spaced from the side edges and running the entire length of said sheet to define a pair of severable, longitudinally extending edge portions; first, second and third transversely extending, parallel fold lines dividing said sheet into first, second, third and fourth panels foldably connected to one another along said fold lines with said first panel being delimited by one of said end edges and said first fold line, said second panel delimited by said first and second fold lines, said third panel delimited by said second and third fold lines and said fourth panel delimited by said third fold line and the other end edge, said second and third panels being foldable over one another along said second fold line to form a first mailing envelope with said second and third panels defining respectively front and rear panels of said first mailing envelope; first adhesive means for adhesively fastening in superimposed relationship the edge portions of said second and third panels when folded over one another to thereby define opposite first and second tear strips; said first panel defining a first adhesive closure flap foldable along said first fold line to seal said first mailing envelope; transversely extending third and fourth tear lines equidistantly spaced respectively inwardly and outwardly from said first fold line to define a third tear strip when said first adhesive closure flap is folded to seal said first mailing envelope such that the sealed first mailing envelope is adapted to be converted into a return envelope by tearing off said first, second and third tear strips and by refolding said second and third panels inside out along said second fold line to form said return envelope with said second and third panels defining respectively rear and front panels of said return envelope; second adhesive means inwardly of and adjacent the edge portions of one of said second and third panels for adhesively fastening together said second and third panels when refolded inside out; said fourth panel defining a second adhesive closure flap foldable over said third panel along said third fold line to nest inside said first mailing envelope and being unfoldable to seal said return envelope when formed.

2. A blank as claimed in claim 1, further including longitudinally extending fifth and sixth panels foldably connected to the edge portions of one of said second and third panels along fourth and fifth fold lines extending along said side edges, said fifth and sixth panels having therealong said first adhesive means to thereby define a pair of foldable side sealing flaps for adhesively fastening the edge portions of said second and third panels.

3. A blank as claimed in claim 1, further including transversely extending fifth and sixth tear lines equidistantly spaced respectively inwardly and outwardly from said third fold line to define a fourth tear strip when said second adhesive closure flap is folded to nest inside said first mailing envelope, said fourth tear strip being substantially coextensive with said third tear strip and encloseable therewithin when said first adhesive closure flap is folded to seal said first mailing envelope such that said third and fourth tear lines register with said fifth and sixth tear lines whereby said third and fourth tear strips are detachable together, and wherein transversely extending first and second spaced-apart score lines are defined in said fourth panel between said sixth tear line and said other end edge with said first score line located adjacent said sixth tear line, said sixth tear line together with said first and second score lines subdividing said fourth panel into first, second, third and fourth sub-panels with said first sub-panel being delimited by said third fold line and said sixth tear line, said second sub-panel delimited by said sixth tear line and said first score line, said third sub-panel delimited by said first and second score lines and said fourth sub-panel delimited by said second score line and said other end edge and having a strip of adhesive extending adjacent said other end edge for sealing said return envelope, said second sub-panel also having adhesive for adhesion to said third panel when said second adhesive closure flap is folded to nest inside said first mailing envelope such as to permit said third and fourth sub-panels to remain foldably connected to said third panel when said first, second, third and fourth tear strips are torn off, said third sub-panel being foldable over said second sub-panel along said first score line and said fourth sub-panel being foldable along said second score line to seal said return envelope.

4. A blank as claimed in claim 3, wherein said first sub-panel as well as the edge portions of said third and fourth sub-panels are provided with adhesive for adhesion to said third panel when said second adhesive closure flap is folded to nest inside said first mailing envelope.

5. A blank as claimed in claim 1, wherein said first and second tear lines are rectilinear and extend in parallel relationship, and wherein said second adhesive means comprise a pair of longitudinally extending strips of pressure-sensitive adhesive arranged on one of said second and third panels inwardly of and adjacent the edge portions thereof, said strips of pressure-sensitive adhesive extending parallel to said first and second tear lines and each being covered by a peel-off protective tape, said protective tape being peelable to expose the pressure-sensitive adhesive of each strip for adhesively fastening together said second and third panels when refolded inside out to form said return envelope.

6. A blank as claimed in claim 5, wherein said strips of pressure-sensitive adhesive are arranged on said second panel and each terminate at one end a short distance from said third tear line, and wherein each protective tape extends beyond said one end of each adhesive strip and across said third tear line to terminate at one end between said first fold line and said third tear line, each protective tape having both ends thereof permanently secured to said second panel and being severable at said one end along said third tear line and at the other end along a transverse tear line formed in said tape adjacent said other end.

7. A blank as claimed in claim 1, wherein a pair of longitudinally extending score lines are defined in said second panel inwardly of and adjacent the edge portions thereof, each score line extending across said second panel, said first and second tear lines each having a longitudinally extending first line section running across said first panel in alignment with a respective one of said score lines, a longitudinally extending second line section which is off-set relative to said first line section and runs across said second panel intermediate said respective score line and a respective one of said side edges, a longitudinally extending third line section running across said third and fourth panels in alignment with said respective score line, and a transversely extending fourth line section interconnecting said second and third line sections and running along said second fold line, and wherein said second adhesive means comprise a pair of longitudinally extending strips of adhesive arranged on said second panel and each extending between a respective one of said score lines and a respective one of said second line sections to thereby define a pair of longitudinally extending foldable side sealing flaps for adhesively fastening together said second and third panels when refolded inside out to form said return envelope, the adhesive of said side sealing flaps being exposable upon tearing off said first and second tear strips and said side sealing flaps being foldable along said score lines to adhesively fasten said second and third panels.

8. A blank as claimed in claim 1, wherein said second panel is formed with a window through which may be displayed address information for first mailing.

9. A blank as claimed in claim 8, further including another panel detachably connected to said fourth panel along a further tear line extending along said other end edge, said other panel defining an information sheet with information printed thereon including said address information.

10. A two-way mailing envelope for both first and return mailing, said envelope having top, bottom and side edges and comprising a pair of panels foldably connected to each other along one fold line extending along said bottom edge and folded over one another along side one fold line to form a first mailing envelope with one of said panels defining a front panel of said first mailing envelope and the other panel defining a rear panel thereof; first adhesive means adhesively fastening in superimposed relationship side edge portions of said panels to form a pocket for said first mailing envelope; first and second side tear strips severable along respective first and second tear lines and including said side edge portions; a first adhesive closure flap foldably connected to said one panel along another fold line extending parallel to said one fold line and along the top edge of said first mailing envelope, said first adhesive closure flap being foldable along said other fold line to seal said first mailing envelope; third and fourth tear lines equidistantly spaced inwardly and outwardly from said other fold line to define a third tear strip when said first adhesive closure flap is folded to seal said first mailing envelope such that the sealed first mailing envelope is adapted to be converted into a return envelope by tearing off said first, second and third tear strips and by refolding said panels inside out along said one fold line to form said return envelope with said one panel and said other panel defining respectively rear and front panels of said return envelope; second adhesive means inwardly of and adjacent the edge portions of one of said panels for adhesively fastening together said panels when refolded inside out to form a pocket for said return envelope; and a second adhesive closure flap foldably connected to said other panel along a further fold line extending parallel to said one fold line, said second adhesive closure flap being folded along said further fold line to nest inside said first mailing envelope and being unfoldable to seal said return envelope when formed.

11. An envelope as claimed in claim 10, wherein the side edge portions of said panels are adhesively fastened by means of a pair of side sealing flaps provided with said first adhesive means and foldably connected to one of said panels along respective fold lines extending along said side edges, said side sealing flaps being folded along said respective fold lines to adhesively fasten said side edge portions.

12. An envelope as claimed in claim 10, further including fifth and sixth tear lines equidistantly spaced respectively inwardly and outwardly from said further fold line and defining a fourth tear strip substantially coextensive with said third tear strip and encloseable therewithin when said first adhesive closure flap is folded to seal said first mailing envelope such that said third and fourth tear lines register with said fifth and sixth tear lines whereby said third and fourth tear strips are detachable together, and wherein first and second spaced-apart score lines are defined in said second adhesive closure flap between a terminal edge thereof and said sixth tear line with said first score line located adjacent said sixth tear line, said sixth tear line together with said first and second score lines subdividing said second adhesive closure flap into first, second, third and fourth flap portions with said first flap portion being delimited by said further fold line and said sixth tear line, said second flap portion delimited by said sixth tear line and said first score line, said third flap portion delimited by said first and second score lines and said fourth flap portion delimited by said second score line and said terminal edge and having a strip of adhesive extending adjacent said terminal edge for sealing said return envelope, said second flap portion also having adhesive for adhesion to said other panel such as to permit said third and fourth flap portions to remain foldably connected to said other panel when said first, second, third and fourth tear strips are torn off, said third flap portion being foldable over said second flap portion along said first score line and said fourth flap portion being foldable along said second score line to seal said return envelope.

13. An envelope as claimed in claim 12, wherein said first flap portion as well as edge portions of said third and fourth flap portions are provided with adhesive for adhesion to said other panel.

14. An envelope as claimed in claim 10, wherein said first and second tear lines extend in parallel relationship and each have four rectilinear sections extending respectively across said two panels and said first and second adhesive closure flaps in registry with one another when said first adhesive closure flap is folded to seal said first mailing envelope, and wherein said second adhesive means comprise two strips of pressure-sensitive adhesive arranged on one of said panels inwardly of and adjacent the edge portions thereof, said strips of pressure-sensitive adhesive extending parallel to said first and second tear lines and each being covered by a peel-off protective tape, said protective tape being peelable to expose the pressure-sensitive adhesive of each strip for adhesively fastening together said panels when refolded inside out to form said return envelope.

15. A blank as claimed in claim 14, wherein said strips of pressure-sensitive adhesive are arranged on said one panel and each terminate at one end a short distance from said third tear line, and wherein each protective tape extends beyond said one end of each adhesive strip and across said third tear line to terminate at one end between said other fold line and said third tear line, each protective tape having both ends thereof permanently secured to said one panel and being severable at said one end along said third tear line and at the other end along a transverse tear line formed in said tape adjacent said other end.

16. An envelope as claimed in claim 10, wherein a pair of score lines are defined in said one panel inwardly of and adjacent the edge portions thereof, each score line extending across said one panel, said first and second tear lines each having a first line section extending across said first adhesive closure flap in alignment with a respective one of said score lines, a second line section which is off-set relative to said first line section and extends across said one panel intermediate said respective score line and a respective one of said side edges, a third line section extending across said other panel and said second adhesive closure flap in registry with said respective score line, and a fourth line section interconnecting said second and third line sections and extending along said one fold line, and wherein said second adhesive means comprise a pair of adhesive strips arranged on said one panel and each extending between a respective one of said score lines and a respective one of said second line sections to thereby define a pair of foldable side sealing flaps for adhesively fastening together said panels when refolded inside out to form said return envelope, the adhesive of said side sealing flaps being exposable upon tearing off said first and second tear strips and said side sealing flaps being foldable along said score lines to adhesively fasten said panels.

17. An envelope as claimed in claim 10, wherein said one panel is formed with a window through which may be displayed address information for first mailing.

18. A blank as claimed in claim 17, further including an information sheet detachably connected to said second adhesive closure flap along a further tear line extending along a terminal edge of said second adhesive closure flap, said information sheet having information printed thereon including said address information.

* * * * *